US008899552B2

(12) United States Patent
Haynes

(10) Patent No.: US 8,899,552 B2
(45) Date of Patent: Dec. 2, 2014

(54) SYSTEMS AND METHODS OF INSTALLING SKID PLATES TO VEHICLES

(76) Inventor: George C. Haynes, Knoxville, TN (US)

( * ) Notice: Subject to any disclaimer, the term of this patent is extended or adjusted under 35 U.S.C. 154(b) by 850 days.

(21) Appl. No.: 13/088,074

(22) Filed: Apr. 15, 2011

(65) Prior Publication Data

US 2012/0091645 A1 Apr. 19, 2012

Related U.S. Application Data

(60) Provisional application No. 61/324,500, filed on Apr. 15, 2010.

(51) Int. Cl.

| | |
|---|---|
| ***B66F 3/00*** | (2006.01) |
| ***B66F 9/18*** | (2006.01) |
| ***B25B 11/00*** | (2006.01) |
| ***B25B 11/02*** | (2006.01) |
| ***B66F 3/36*** | (2006.01) |
| ***E02F 9/08*** | (2006.01) |

(52) U.S. Cl.

CPC . *B25B 11/00* (2013.01); *B66F 9/18* (2013.01); *B25B 11/02* (2013.01); *B66F 3/36* (2013.01); *E02F 9/0808* (2013.01)

USPC ..... 254/3 R; 254/134

(58) Field of Classification Search

CPC ..... B62B 3/0625; B66F 3/42; B66F 5/04; B66F 3/38

USPC ..... 254/3 R, 3 B, 3 C, 5 R, 5 B, 5 C, 93 H

See application file for complete search history.

(56) References Cited

U.S. PATENT DOCUMENTS

| | | | | |
|---|---|---|---|---|
| 1,734,816 | A * | 11/1929 | Ludwig | 60/480 |
| 2,147,030 | A * | 2/1939 | Haskin | 254/1 |
| 2,631,006 | A * | 3/1953 | Sick | 254/3 R |
| 2,988,354 | A * | 6/1961 | Schultz | 269/60 |
| 3,170,672 | A * | 2/1965 | Stoneberg | 254/93 R |
| 4,759,684 | A * | 7/1988 | Lanzillotta et al. | 414/678 |
| 6,409,153 | B1 * | 6/2002 | Norris | 254/93 R |

* cited by examiner

*Primary Examiner* — Lee D Wilson
*Assistant Examiner* — Jamal Daniel
(74) *Attorney, Agent, or Firm* — Pitts & Lake, P.C.

(57) ABSTRACT

An apparatus to support a skid plate during installation to an underside of a vehicle, the apparatus including a lower frame, a lifting apparatus mounted to the lower frame, and an upper frame mounted to the lifting apparatus such that the lifting apparatus selectively raises or lowers the upper frame relative to the lower frame to adjust the height of the skid plate relative to an installation surface of the vehicle. The upper frame can rotate about a longitudinal axis of the lifting apparatus and can pivot about an axis generally perpendicular to the longitudinal axis to orient the skid plate relative to the installation surface.

7 Claims, 11 Drawing Sheets

SYSTEMS AND METHODS OF INSTALLING SKID PLATES TO VEHICLES

CROSS-REFERENCE TO RELATED APPLICATIONS

This application claims the benefit of U.S. Provisional Application No. 61/324,500 filed Apr. 15, 2010.

BACKGROUND

1. Field of Inventive Concept

The present general inventive concept relates generally to skid plates, and more particularly relates to a movable supporting device to support and orient a skid plate during installation to a vehicle, and methods of using the same.

2. Description of the Related Art

Skid plates are typically installed to the underside of vehicles to protect underbody components from damaging impacts with the ground, rocks, stumps, or the like during use of the vehicle. Such plates are particularly important in off-road vehicles where the vehicles are used in extreme conditions and the likelihood of severe impacts are great.

Skid plates are typically relatively large and heavy to maneuver, and they are generally configured of strong, heavy material in order to absorb severe impacts without distortion. Due to their extreme shape and size, skid plates can be difficult to install to the underside of vehicles, making replacement and repair of the skid plates problematic, for example when the skid plate or vehicle has been damaged. Skid plates are typically secured between portions of the frame or body at a location laterally and downwardly spaced from an underside of the engine, and may be secured beneath the engine to prevent direct impacts of objects to the engine.

Known methods of installing and removing skid plates to the underside of vehicles do not satisfactorily perform due to the extreme size and shape of the skid plates. It is important to maintain adequate support for the skid plate during lifting, balancing, maneuvering, and fastening of skid plates to the underside of a vehicle frame or body, especially when the mounting locations of the skid plates are susceptible to shearing and deformation, which may result in damage to not only the skid plate but also the vehicle frame or body.

SUMMARY

The present general inventive concept provides a movable supporting device to support a skid plate as it is removed from or attached to a vehicle, such as an earthmover or other off-road vehicle.

The supporting device can include a frame portion mounted upon casters. The frame portion can include a bed portion to support a skid plate thereon. A lifting mechanism, such as a jack, can be mounted upon the frame to selectively raise or lower the bed portion with respect to the frame portion. The bed portion can be rotatably mounted about a longitudinal axis of the lifting mechanism, and the bed can also be pivotable about an axis generally perpendicular to the longitudinal axis of the lifting mechanism.

Additional features and embodiments of the present general inventive concept will be set forth in part in the description which follows and, in part, will be obvious from the description, or may be learned by practice of the general inventive concept.

Example embodiments of the present general inventive concept can be achieved by providing a movable supporting device including a frame mounted upon casters, a jack having a vertically adjustable piston mounted upon the frame, and a bed rotatably mounted upon an outboard end of the vertically adjustable piston for rotation around an axis defined by the vertically adjustable piston, the bed also being pivotable about an axis generally perpendicular to the axis defined by the vertically adjustable piston.

Example embodiments of the present general inventive concept can also be achieved by providing an apparatus to support a skid plate during installation to a vehicle, including a lower frame, a lifting apparatus mounted to the lower frame, and an upper frame mounted to the lifting apparatus such that the lifting apparatus selectively raises or lowers the upper frame relative to the lower frame to adjust the height of the skid plate relative to an installation surface of the vehicle. The upper frame can rotate about a longitudinal axis of the lifting apparatus and can pivot about an axis generally perpendicular to the longitudinal axis to orient the skid plate relative to the installation surface.

The apparatus can have a pivot assembly to mount the upper frame to the lifting apparatus, including a center plate having a support member rotatably connected to the lifting apparatus such that the center plate rotates about the longitudinal axis of the lifting apparatus via the support member. The center plate can have a plurality of adjustment holes therein. A first plate can be mounted to the upper frame adjacent to a first side of the center plate, and a second plate can be mounted to the upper frame adjacent to a second side of the center plate opposite the first side. A locking member can be mounted to the first plate to selectively engage at least one of the adjustment holes such that when the locking member is disengaged from the adjustment holes, the upper frame pivots within a range of predetermined angles relative to the lower frame, and when the locking member is engaged in at least one of the adjustment holes, the upper frame is locked at a predetermined angle determined by a position of the at least one engaged adjustment hole in the center plate.

The upper frame can include a pair of lengthwise members and a pair of cross members to form a generally rectangular shape, and the pivot assembly can be connected between the pair of lengthwise members such that the pivot assembly is located substantially in the middle of the rectangular shape.

The lifting apparatus can include a hydraulic jack having a base portion mounted to the lower frame and a reciprocating jack piston extending from the base portion to the center plate.

The lifting apparatus can include a first hydraulic lift and a second hydraulic lift. The first hydraulic lift can include a base plate and at least four hydraulic jack members spaced apart along a perimeter of the base plate, each of the four hydraulic jack members having reciprocating jack rods operatively connected to the second hydraulic lift to selectively raise and lower the second hydraulic lift relative to the first hydraulic lift.

A set of angular support members can be spaced apart along a peripheral surface of the lengthwise members to form a v-shaped opening above the upper frame member to support a skid plate therein.

An air pump assembly can be mounted to the lower frame to operate the hydraulic jack including a control unit to selectively raise and lower the hydraulic jack according to input of a user.

A plurality of wheels can be mounted to the lower frame, wherein at least two of the wheels comprise automatic drive wheels to facilitate directional movement and steering of the apparatus.

A set of support legs can be respectively mounted to corner portions of the lower frame to support the lower frame above a ground surface. Each of the support legs can include a wheel to facilitate movement of the apparatus about the ground surface.

The support legs can include telescoping support legs to selectively raise and lower the lower frame relative to the ground surface. The support legs can also include pivoting hydraulic legs to selectively pivot between a substantially horizontal orientation and a substantially vertical orientation, wherein the substantially horizontal orientation corresponds to a lowered position of the lower frame relative to the ground surface, and the substantially vertical position corresponds to a raised position of the lower frame relative to the ground surface.

Example embodiments of the present general inventive concept can also be achieved by providing a method of installing skid plates to the underside of a vehicle, including forming a lower frame to support a reciprocating lift member, forming an upper frame to support a skid plate, connecting a first end of the reciprocating lift member to the lower frame, connecting a second end of the reciprocating lift member to the upper frame to form an integrated assembly comprising the lower frame, upper frame, and reciprocating lift member.

The method can also include using the reciprocating lift member to selectively raise or lower the upper frame relative to the lower frame to adjust the height of the skid plate relative to an installation surface of the vehicle, pivoting the upper frame about an axis generally horizontal to the ground surface to position the skid plate at an angle substantially matching an angle of the installation surface, rotating the upper frame about an axis generally vertical to the ground surface to orient the skid plate according to an orientation of the installation surface, fastening the skid plate to the installation surface while the skid plate is oriented and carried by the upper frame.

BRIEF DESCRIPTION OF THE SEVERAL VIEWS OF THE DRAWINGS

The following example embodiments are representative of exemplary techniques and structures designed to carry out the objectives of the present general inventive concept, but the present general inventive concept is not limited to these example embodiments. Additional embodiments and/or features of the present general inventive concept will become more clearly understood from the following detailed description of the example embodiments read together with the accompanying drawings in which.

DETAILED DESCRIPTION

Figure 1:
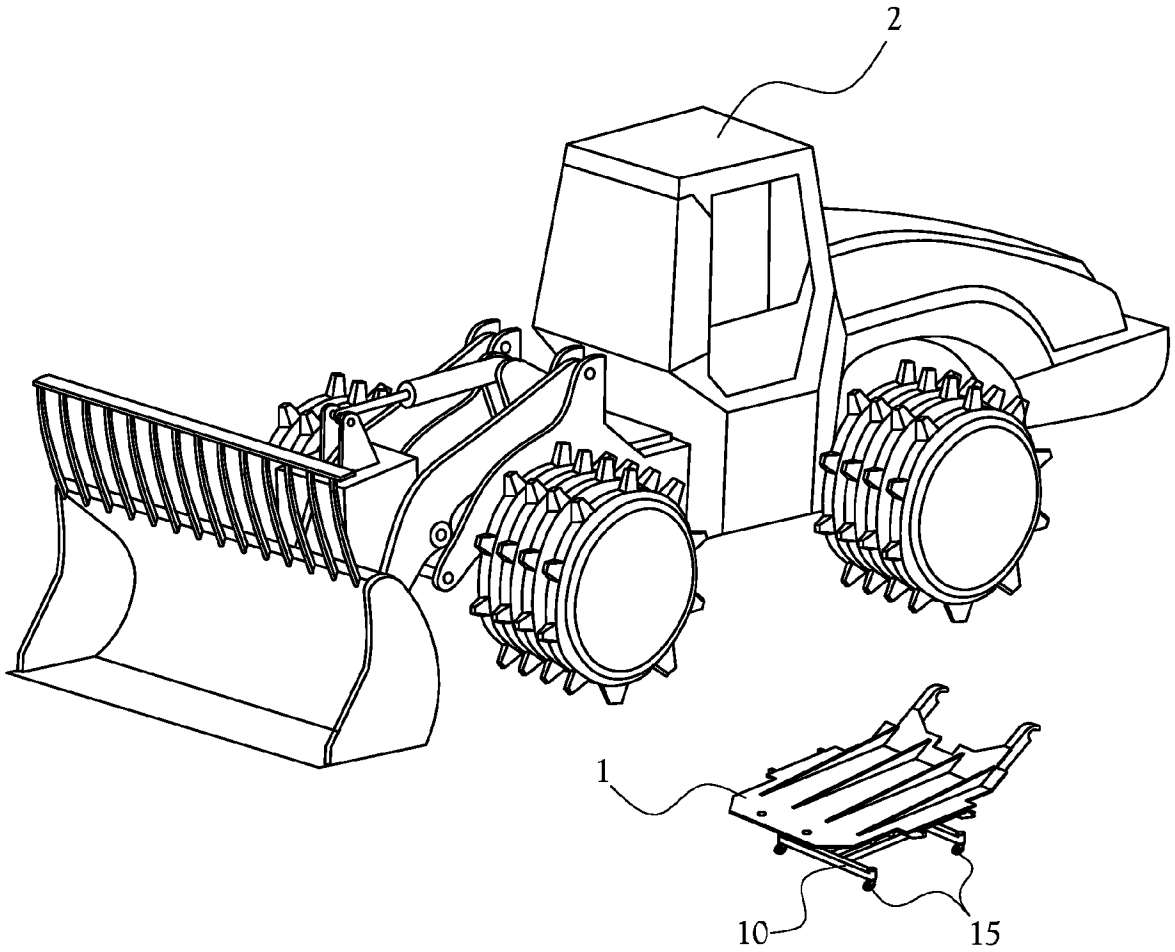
FIG. 1 is a perspective view of an exemplary skid plate unit secured to a movable load table according to an example embodiment of the present general inventive concept, including an exemplary off-road vehicle.

Reference will now be made to various embodiments of the present general inventive concept, examples of which are illustrated in the accompanying drawings, wherein like reference numerals refer to like elements throughout. The following description of the various embodiments is merely exemplary in nature and is in no way intended to limit the present general inventive concept, its application, or uses. The example embodiments are merely described below in order to explain the present general inventive concept by referring to the figures. It is noted that in the accompanying drawings and illustrations, the sizes and relative sizes, shapes, and qualities of lines, entities, and regions may be exaggerated for clarity and/or convenience of illustration.

It is also noted that throughout the following description, spatially relative terms, such as "up," "down," "right," "left," "beneath," "below," "lower," "above," "upper" and the like, may be used for ease of description to describe one element or feature's relationship to another element(s) or feature(s) as illustrated in the figures. It will be understood, however, that these spatially relative terms are intended to encompass different orientations of the device in use or operation in addition to the orientation depicted in the figures, and are provided for convenience of description only with reference to the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

FIG. 1 is a perspective view of an exemplary skid plate supporting device configured in accordance with an exemplary embodiment of the present general inventive concept. The operating environment of FIG. 1 includes a skid plate 1 mounted to a supporting device ready for installation to the underside of an exemplary vehicle 2. The supporting device includes a frame portion 10 and a plurality of wheels 15 to facilitate movement of the supporting device about a ground surface. The vehicle 2 illustrated in FIG. 1 can take various forms such as an earth moving vehicle, a trash compactor vehicle, or other types of off-road vehicles, but the present general inventive concept is not limited to application to any particular type of vehicle, and all such vehicles are intended to be encompassed within the broader scope and applicability of the present general inventive concept.

Figure 2:
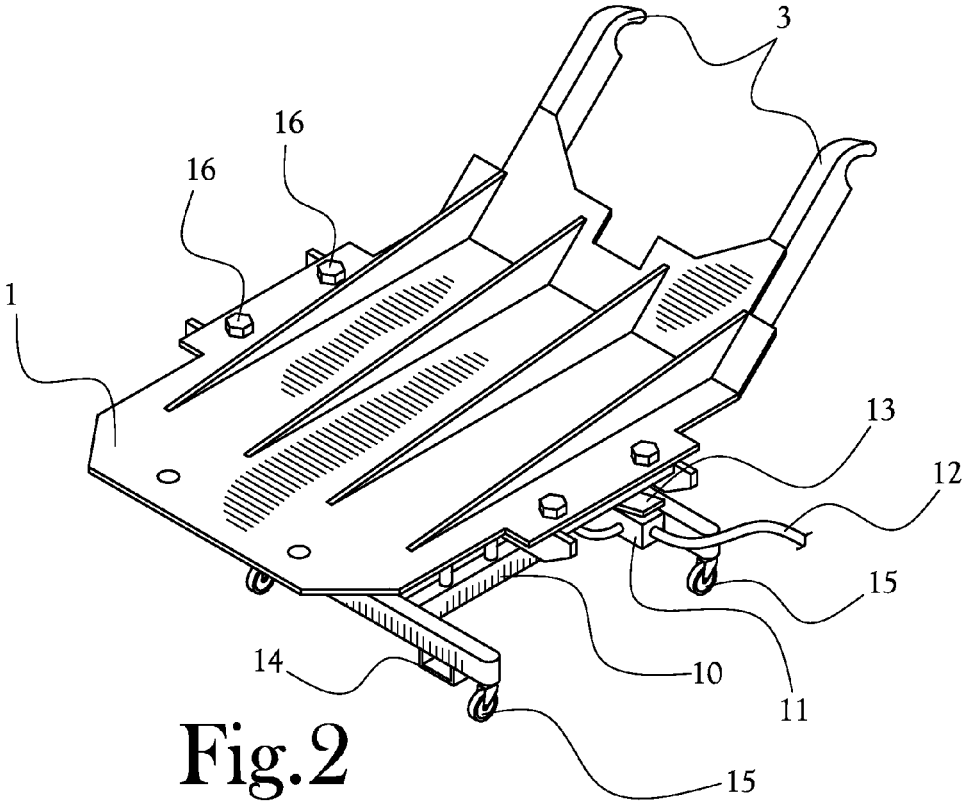
FIG. 2 is a top perspective view of an exemplary skid plate apparatus secured to a movable supporting device according to an example embodiment of the present general inventive concept.
Figure 3:
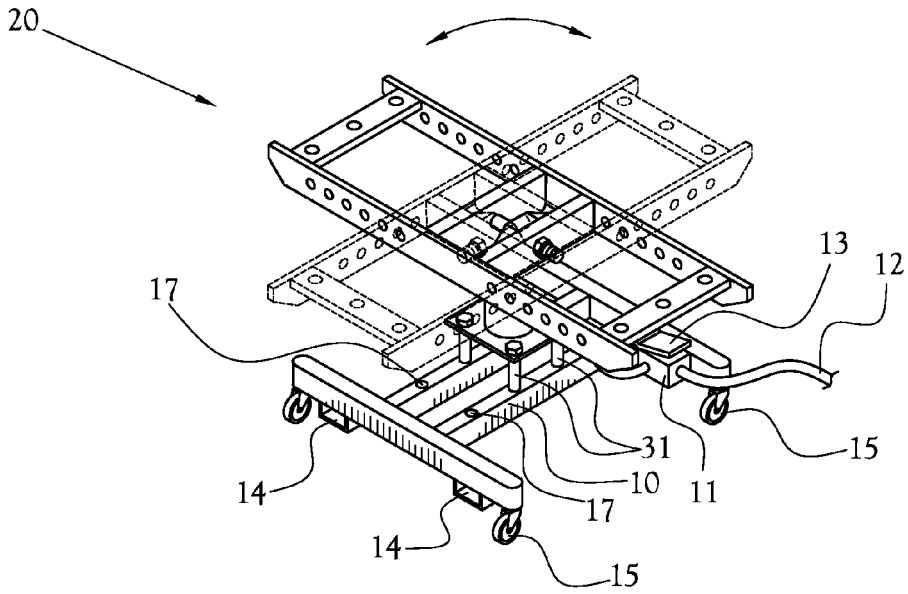
FIG. 3 is a top perspective view of an exemplary movable supporting device configured in accordance with an example embodiment of the present general inventive concept where a top bed portion of the supporting device is shown in phantom lines to better illustrate rotational movement of the top bed portion about a vertical axis of the supporting device.

FIG. 2 is a top perspective view of an exemplary skid plate apparatus secured to a movable supporting device according to an example embodiment of the present general inventive concept, and FIG. 3 is a top perspective view of an exemplary movable supporting device configured in accordance with an example embodiment of the present general inventive concept where a top bed portion of the supporting device is shown in phantom lines to better illustrate rotational movement of the top bed portion about a vertical axis of the supporting device.

Referring to FIGS. 2 and 3, the supporting device includes a wheel frame 10 and a plurality of wheels 15. Mounted to the wheel frame 10 can be two or more fork lift members configured to receive the forks of a fork lift truck to lift the supporting device, if needed. The wheel frame can include a set of apertures 17 to receive a plurality of risers 31 to support a jack lift, as described in more detail below in connection with FIG. 4.

In some embodiments, the skid plate 1 can include one or more hooks 3 to facilitate mounting of the skid plate 1 to the underside of the vehicle 2. The skid plate 1 is supported on the supporting device by a bed frame 20. The skid plate can be secured to the bed frame 20 by one or more fasteners 16 to prevent the skid plate from falling off the bed frame 20 during installation operations. The wheel frame 10 can include an air pump 11, hydraulic tube 12, and foot pedal 13 to operate one or more hydraulic jacks mounted between the wheel frame 10 and the bed frame 20.

Figure 4:
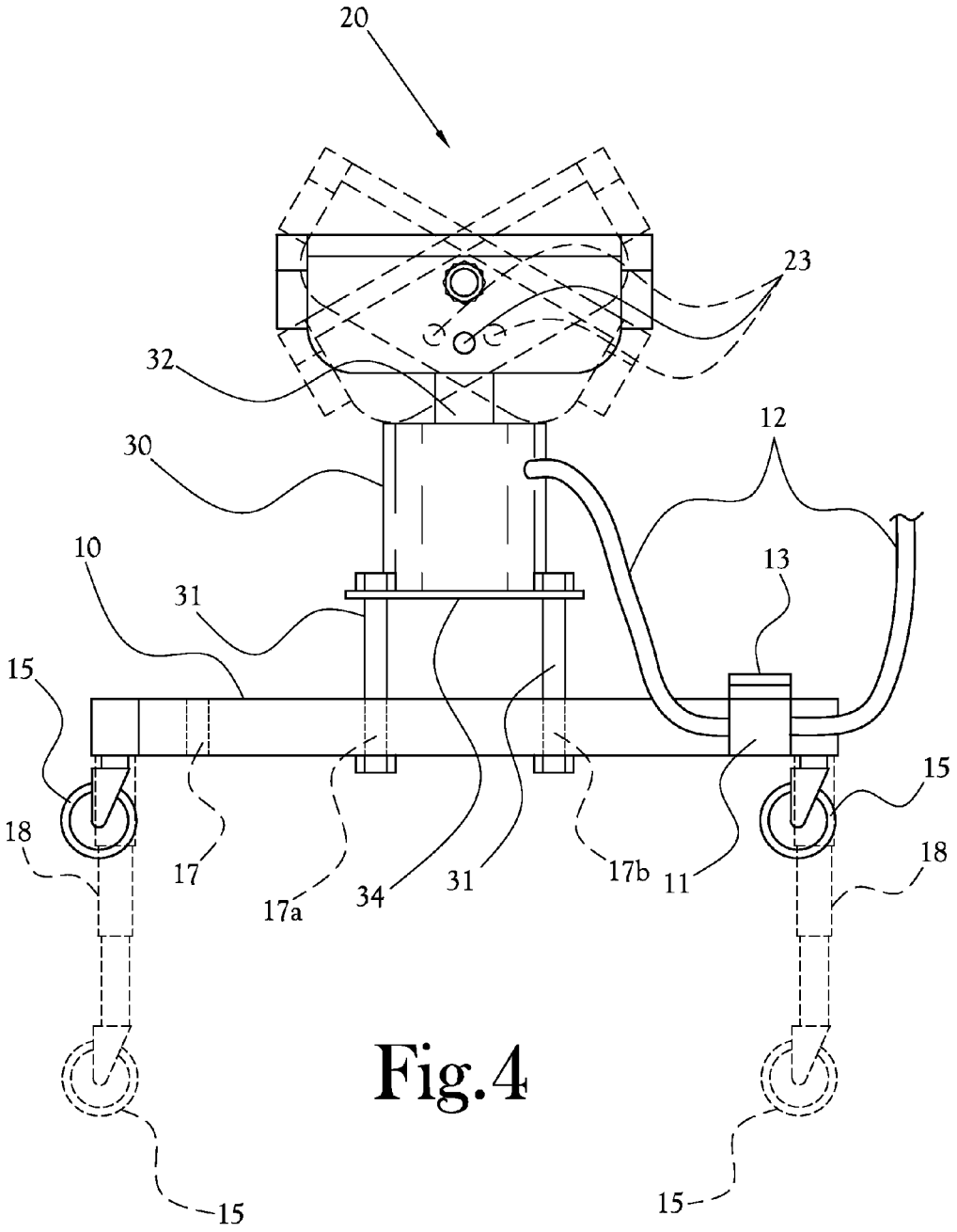
FIG. 4 is a side view of an exemplary movable supporting device configured in accordance with an example embodiment of the present general inventive concept where the top bed portion of the supporting device is shown in phantom lines to better illustrate pivotal movement of the top bed portion about an axis substantially perpendicular to the vertical axis, and leg portions shown in phantom lines to better illustrate the elevating movement of the supporting device.

FIG. 4 is a side view of an exemplary movable supporting device configured in accordance with an example embodiment of the present general inventive concept where the bed frame 20 is shown in phantom lines to better illustrate pivotal movement of the bed frame 20 about a horizontal axis. FIG. 4 also illustrates telescoping leg portions 18 in phantom lines to better illustrate elevating movement of the wheel frame 10 relative to the wheels 15.

As illustrated in FIG. 4, the wheel frame 10 can include a plurality of telescoping legs 18 to facilitate automatic lifting movement of the skid plate supporting device. In some embodiments, the telescoping legs 18 could be connected to the air pump 11 or to other forms of power to facilitate reciprocal movement of the telescoping legs 18. The wheel frame 10 includes a set of apertures 17 configured in shape and size to receive a plurality of risers 31. The risers 31 can be selectively placed in various ones of the apertures to shift the center of gravity to one side or the other of the supporting device to distribute the load depending on the particular shape and size of a given skid plate being carried by the device. In FIG. 4, the risers 31 are located in apertures 17A, 17B of the wheel frame 10, leaving the outermost apertures 17 unused in this configuration.

The risers 31 can take any form chosen with sound engineering judgment to support a suitable lifting mechanism to reciprocally raise and lower the bed frame 20 relative to the wheel frame 10. In the embodiment of FIG. 4, the risers 31 take the form of elongated pillars to support a base plate 34 at a desired elevation. The base plate 34 in turn supports a lifting mechanism comprising a jack base 30 and a jack piston 32. The jack piston can be reciprocally raised and lowered under the control of the foot pedal 13 to direct hydraulic power to the lifting mechanism via the air pump 11 and hydraulic tubes 12.

Figure 5:
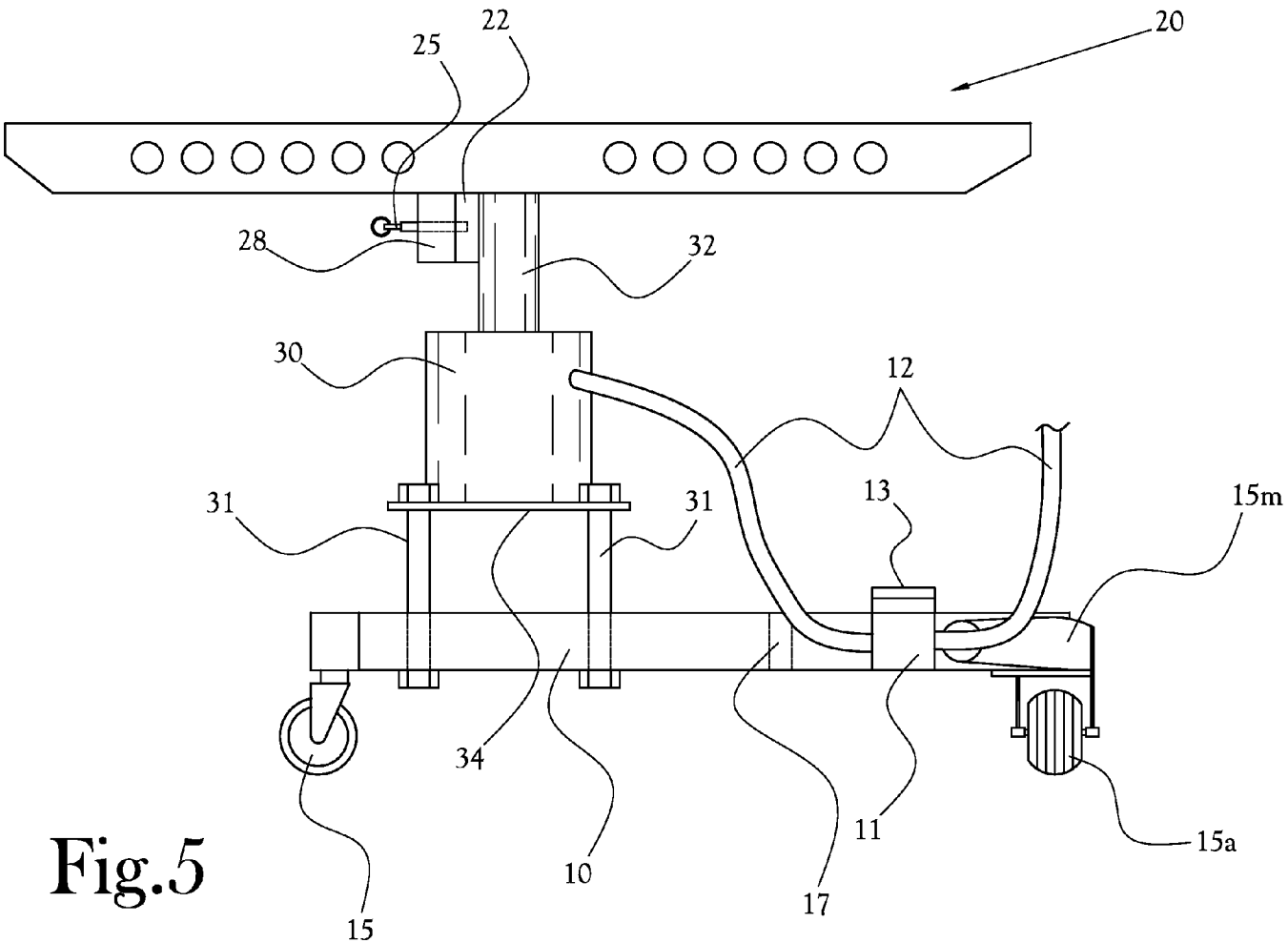
FIG. 5 is a side view of an exemplary movable supporting device including a motorized wheel structure configured in accordance with an example embodiment of the present general inventive concept.

FIG. 5 is a side view of an exemplary movable supporting device including a motorized wheel structure configured in accordance with an example embodiment of the present general inventive concept. As illustrated in FIG. 5, one or more of the wheels 15 can be motorized to assist directional movement of the supporting device when the skid plate is being carried by the supporting device during installation operations. For example, as illustrated in FIG. 5, a pair of wheel motors 15M and drive wheels 15A can be connected to the wheel frame 10 to provide automatic drive power to the supporting device, under the direct or remote control of an operator.

Figure 6:
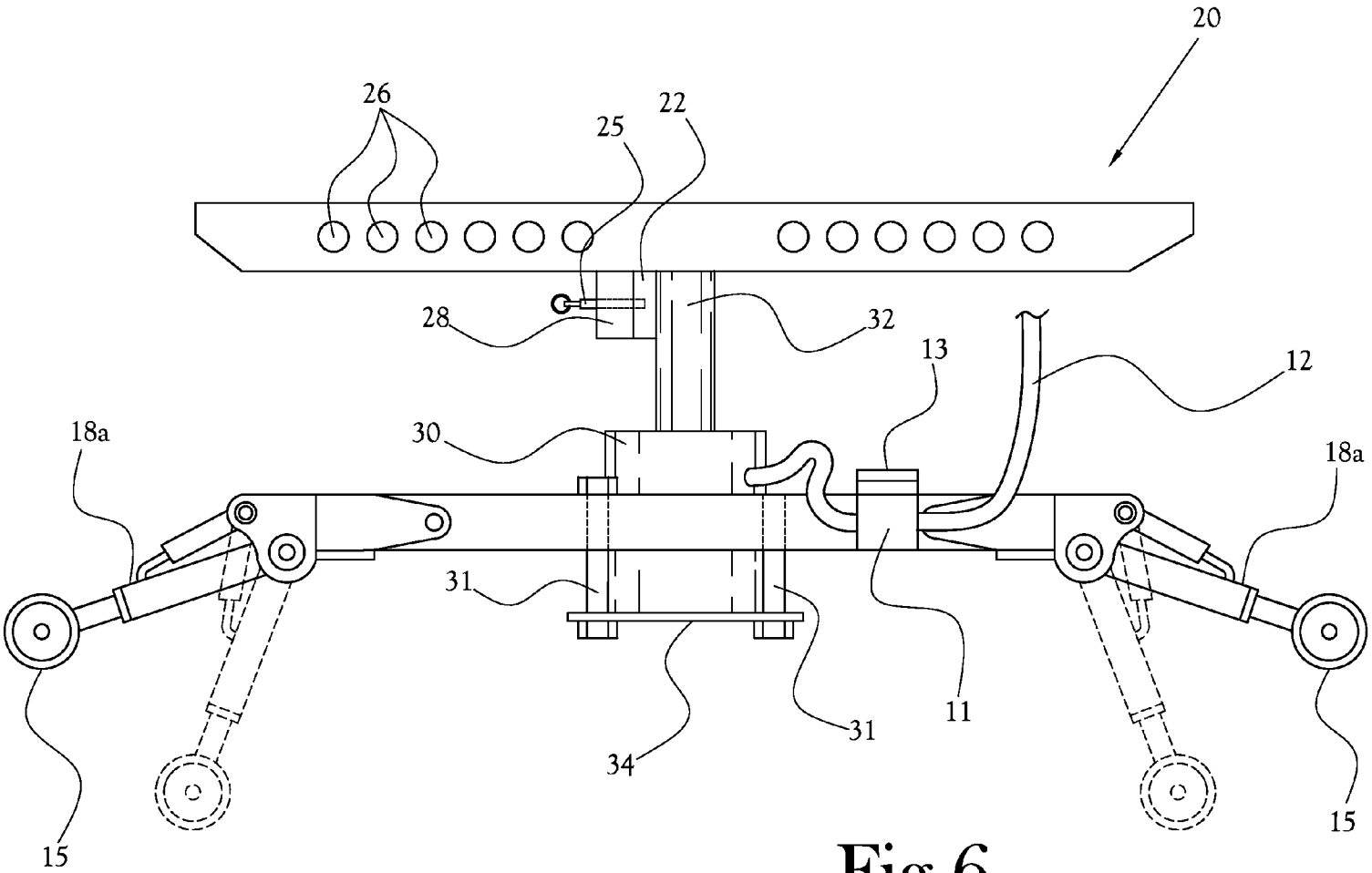
FIG. 6 is a side view of an exemplary movable supporting device including a pivoting leg structure configured in accordance with an example embodiment of the present general inventive concept.

FIG. 6 is a side view of an exemplary movable supporting device including a pivoting leg structure configured in accordance with an example embodiment of the present general inventive concept. In this embodiment, the wheel frame 10 can include a set of hydraulic legs 18A to reciprocally lift or lower the wheel frame 20 as illustrated by the phantom lines of FIG. 6. Here, similar to the telescoping legs 18 of FIG. 4, the hydraulic legs 18A can be connected to air pump 11 or alternative sources of power, under the direct or remote control of an operator, to facilitate reciprocal movement of the legs 18 or 18A. Note that in FIG. 6 the risers 31 and base plate 34 are illustrated below the wheel frame 10, as an alternate configuration. However, those skilled in the art will appreciate that a variety of different combinations and/or configurations of components could be used to achieve the same or similar results without departing from the broader scope and spirit of the present general inventive concept.

Figure 7:
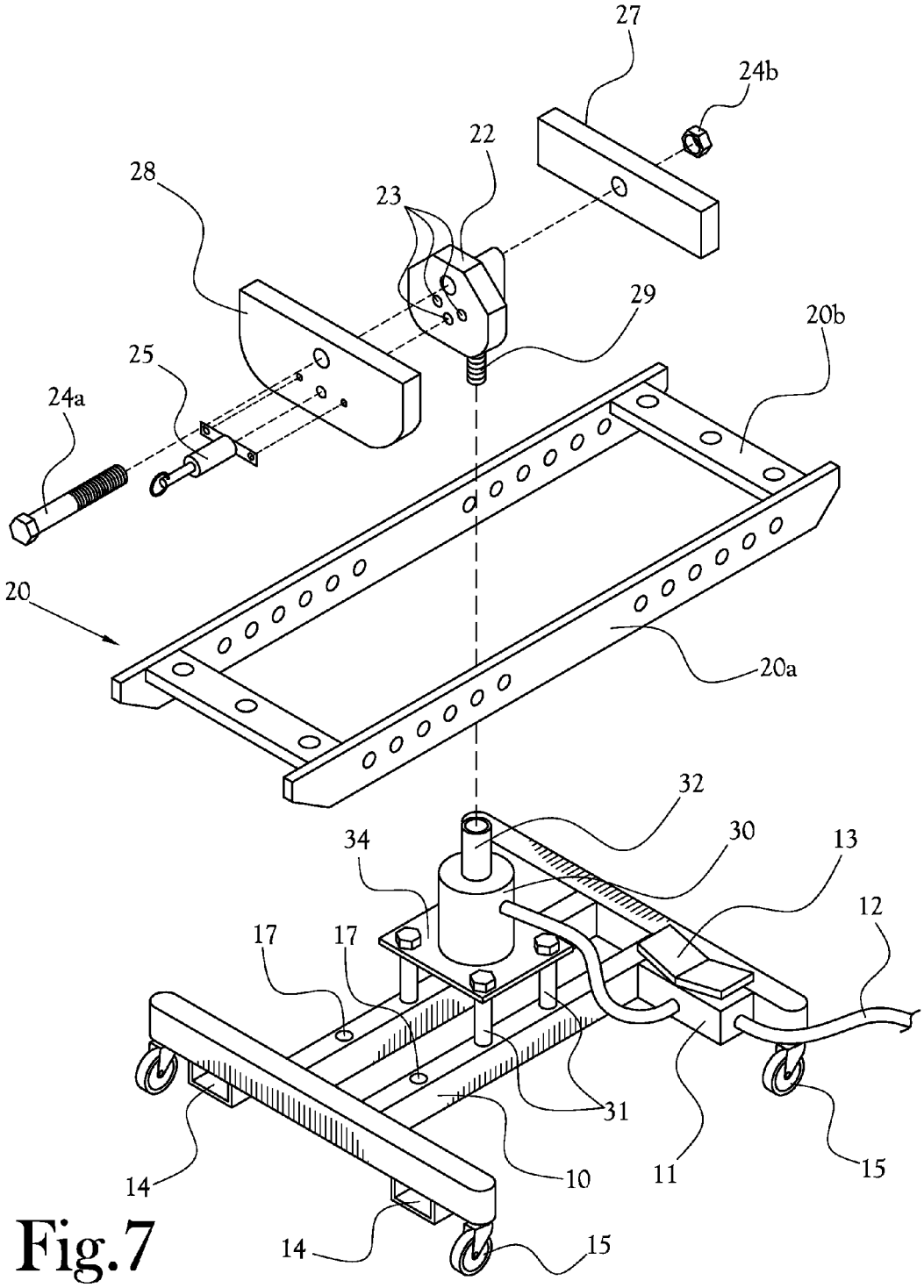
FIG. 7 is an exploded assembly view of an exemplary movable supporting device configured in accordance with an example embodiment of the present general inventive concept.

FIG. 7 is an exploded assembly view of an exemplary movable supporting device configured in accordance with an example embodiment of the present general inventive concept. As illustrated in FIG. 7, the bed frame 20 includes a pair of lengthwise cross members 20A and a pair of crosswise cross members 20B to form a rectangular bed frame 20. To facilitate pivotal and rotational movement of the bed frame 20, the bed frame 20 includes a center pivot block 22, a front pivot block 28, and a rear pivot block 27. In this embodiment, the center pivot block 22 includes at least three adjustment holes 26 and a threaded support member 29 extending from a bottom surface of the center pivot block 22. The threaded support member 29 rotatably connects to an aperture in a top distal end of the jack piston 32 such that the pivot block 22 can rotate about a longitudinal axis of the jack piston 32. The front and rear pivot blocks 28, 27 can be mounted between the lengthwise cross members 20A by welding or other suitable fastening means such that the center pivot block 22 is situated between the front and rear pivot blocks 28, 27. A pivot rod 24A can be inserted through the mating apertures in the front, center, and rear pivot blocks fastened by a nut 24B. A locking pin 25 can be mounted to a front face of the front pivot block 28 such that the locking pin can selectively engage an adjustment hole 23 in the center pivot block.

Referring to FIGS. 4 and 7, if the locking pin 25 engages the middle adjustment hole 23, the bed frame 20 will be oriented in a substantially horizontal manner. However, if it is desired to orient the bed frame at an angle to facilitate installation of a skid plate as illustrated in FIG. 4, it is possible to remove the locking pin 25 from the center adjustment hole and pivot the bed frame 20 about a horizontal axis such that the locking pin 25 mates with another one of the adjustment holes 23, thus locking the bed frame at a predetermined angle, for example 30 degrees relative to horizontal.

Figure 8:
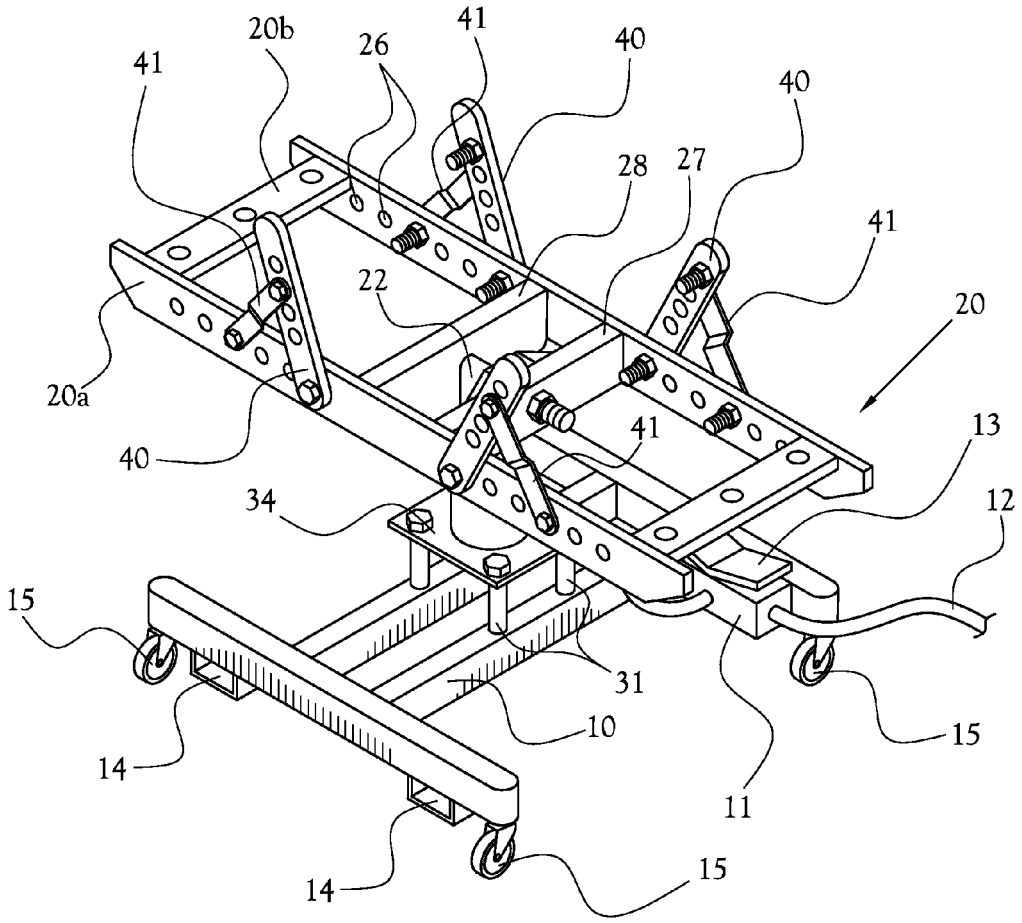
FIG. 8 is a perspective view of an exemplary movable supporting device configured in accordance with an example embodiment of the present general inventive concept.
Figure 9:
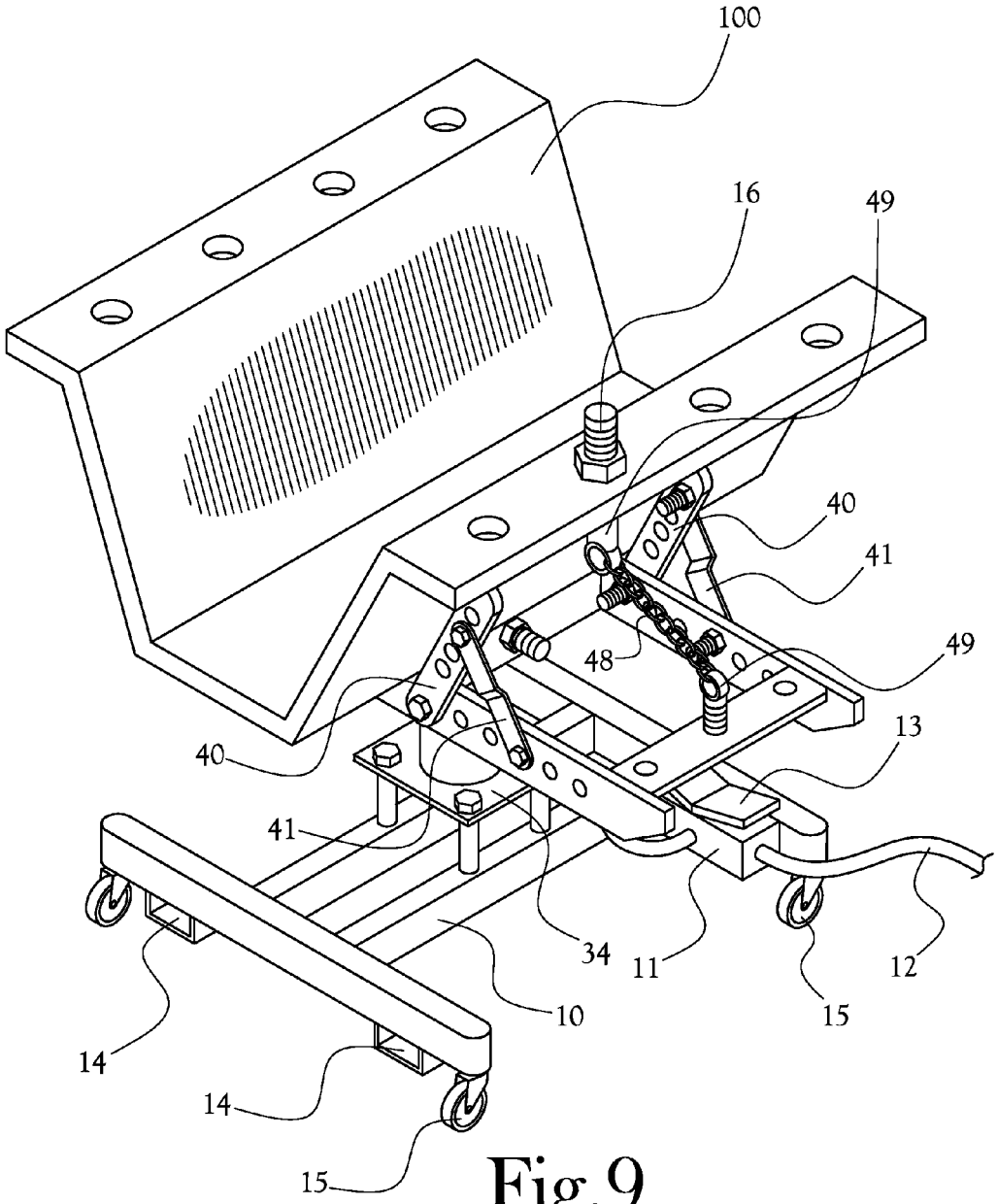
FIG. 9 is a perspective view of an exemplary movable supporting device supporting an exemplary skid plate configured in accordance with an example embodiment of the present general inventive concept.

FIGS. 8 and 9 are perspective views of an exemplary movable supporting device configured in accordance with an example embodiment of the present general inventive concept. In these embodiments, a set of angle plates 40 can be mounted to the lengthwise cross members 20A via fastener holes 26. The angle plates 40 can be supported by associated angle support members 41 to support the angle plates 40 at a desired angle relative to the bed frame 20. The angle plates can thus be oriented to support a v-shaped skid plate 100 on the bed frame 20, as illustrated in FIG. 9. A retention chain 48 can be used in conjunction with eyebolts 49 to secure the skid plate 100 to the bed frame 20, thus preventing the skid plate 100 from accidentally falling off the bed frame 20 during installation operations.

Figure 10:
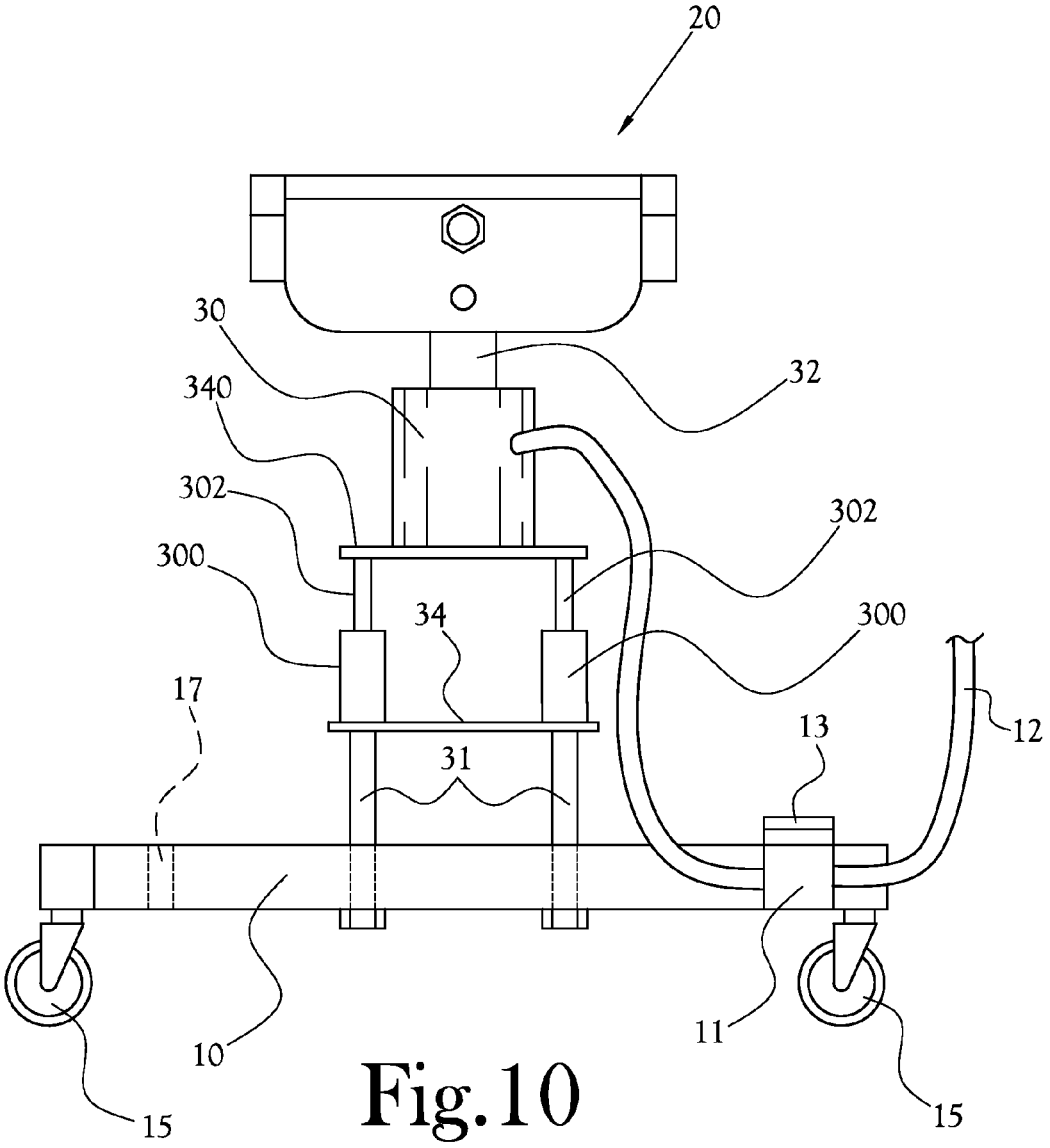
FIG. 10 is a side view of an exemplary movable supporting device including multiple lift structures to lift the bed portion according to an example embodiment of the present general inventive concept.

FIG. 10 is a side view of an exemplary movable supporting device including multiple lift structures to provide additional lift capabilities for the bed portion according to an example embodiment of the present general inventive concept. As illustrated in FIG. 10, it is possible to incorporate one or more lifting mechanisms in addition to the lifting mechanism 30, 32 used in other example embodiments. For example, in the illustrated embodiment, four jack bases 300 can be positioned at each corner of the base plate 34 to reciprocally operate four jack pistons 302. The jack pistons 302 in turn can be connected to another base plate 340 which supports the previously described jack base 30 and associated jack piston 32. Each of the lifting mechanisms can be connected to air pump 11 under the control of foot pedal 13, or other sources of power, to selectively lift or lower the bed frame 20 in stages or simultaneously. The embodiment illustrated in FIG. 10 is illustrative only. Those skilled in the art will appreciate that a variety of different configurations could be chosen with sound engineering judgment, including the use of one or more lifting mechanisms, without departing from the broader scope and spirit of the present general inventive concept.

Figure 11A:
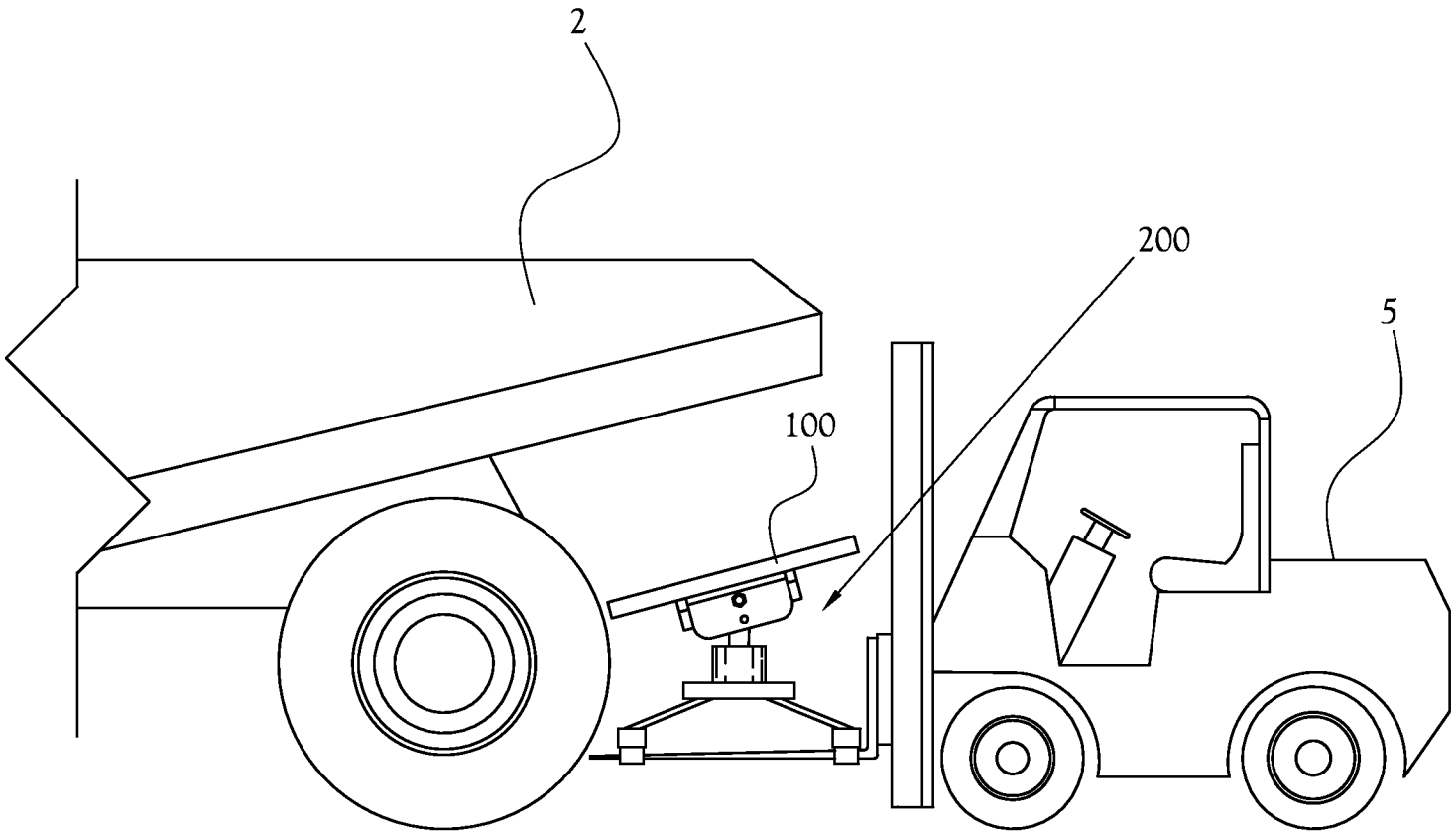
FIG. 11A is a side view illustrating operation of an exemplary system and method of installing skid plates to the underside of a vehicle according to an example embodiment of the present general inventive concept.
Figure 11B:
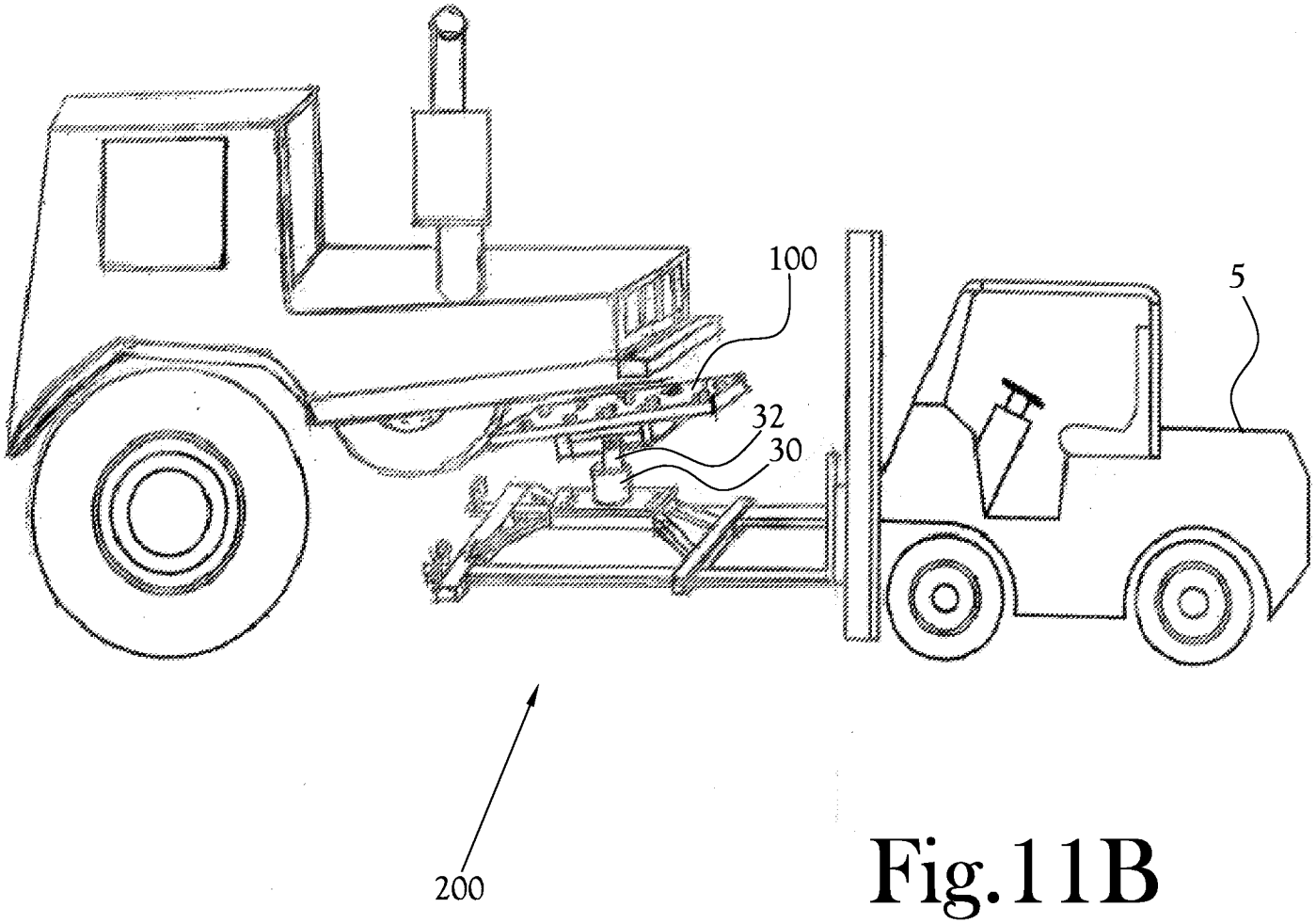
FIG. 11B is a perspective view of an exemplary system and method of installing skid plates to the underside of a vehicle according to an embodiment of the present general inventive concept.

FIGS. 11A and 11B illustrate operation of additional systems and methods of installing skid plates to the underside of a vehicle according to example embodiments of the present general inventive concept. As illustrated in FIGS. 11A and 11B, the skid plate can be secured to the supporting device 200 and angled at a predetermined angle by virtue of the pivotable bed frame 20 described above. By angling the skid plate as illustrated in FIGS. 11A and 11B according to the installation angle of the vehicle, it is possible to tilt the skid plate to match the angular position of the installation surface, thus facilitating quick and easy installation of the skid plate to the underside of the vehicle. As illustrated in FIGS. 11A and 11B, the supporting device 200 can be carried by a fork lift device 5 to roughly position and orient the skid plate at the appropriate position under the vehicle. Once the skid plate is roughly positioned under the vehicle, the jack 30 and jack piston 32 can be used to finely raise/lower the skid plate to an appropriate height to enable fastening of the skid plate to the underside of the vehicle. Rotational adjustment of the skid plate about the longitudinal axis of the jack piston 32 enables the skid plate to be adjusted, if needed, to line-up the holes or fastening members (e.g., nuts, bolts, anchors, clamps, etc.) of the skid plate to a mating attachment member on the underside of the vehicle, thus facilitating safe, convenient, and efficient installation of the skid plate to the underside of the vehicle.

It is noted that the simplified diagrams and drawings do not illustrate all the various connections and assemblies of the various components, however, those skilled in the art will understand how to implement such connections and assemblies, based on the illustrated components, figures, and descriptions provided herein. It is also noted that numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary in the description or claims, there is no requirement for the inclusion in any claim herein or of any application claiming priority hereto of any particular described or illustrated activity or element, any particular sequence of such activities, or any particular interrelationship of such elements.

Thus, while the present general inventive concept has been illustrated by description of several example embodiments, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

What is claimed is:

1. An apparatus to support a skid plate during installation to a vehicle, comprising:

a lower frame;

a lifting apparatus mounted to the lower frame;

an upper frame mounted to the lifting apparatus such that the lifting apparatus selectively raises or lowers the upper frame relative to the lower frame to adjust the height of the skid plate relative to an installation surface of the vehicle, the upper frame being rotatable about a longitudinal axis of the lifting apparatus and pivotable about an axis generally perpendicular to the longitudinal axis to orient the skid plate relative to the installation surface; and a pivot assembly to mount the upper frame to the lifting apparatus, the pivot assembly comprising:

a center plate having a support member rotatably connected to the lifting apparatus such that the center plate rotates about the longitudinal axis of the lifting apparatus via the support member, the center plate including a plurality of adjustment holes therein;

a first plate mounted to the upper frame adjacent to a first side of the center plate;

a second plate mounted to the upper frame adjacent to a second side of the center plate opposite the first side; and a locking member mounted to the first plate to selectively engage at least one of the adjustment holes such that when the locking member is disengaged from the adjustment holes, the upper frame pivots within a range of predetermined angles relative to the lower frame, and when the locking member is engaged in at least one of the adjustment holes, the upper frame is locked at a predetermined angle determined by a position of the at least one engaged adjustment hole in the center plate;

wherein the lifting apparatus comprises a first hydraulic lift and a second hydraulic lift, the first hydraulic lift including a base plate and at least four hydraulic jack members spaced apart along a perimeter of the base plate, each of the four hydraulic jack members having reciprocating jack rods operatively connected to the second hydraulic lift.

2. An apparatus to support a skid plate during installation to a vehicle, comprising:

a lower frame;

a lifting apparatus mounted to the lower frame;

an upper frame mounted to the lifting apparatus such that the lifting apparatus selectively raises or lowers the upper frame relative to the lower frame to adjust the height of the skid plate relative to an installation surface of the vehicle, the upper frame being rotatable about a longitudinal axis of the lifting apparatus and pivotable about an axis generally perpendicular to the longitudinal axis to orient the skid plate relative to the installation surface, wherein the upper frame comprises a pair of lengthwise members and a pair of cross members to form a general rectangular shape;

a pivot assembly to mount the upper frame to the lifting apparatus, the pivot assembly comprising:

a center plate having a support member rotatably connected to the lifting apparatus such that the center plate rotates about the longitudinal axis of the lifting apparatus via the support member, the center plate including a plurality of adjustment holes therein;

a first plate mounted to the upper frame adjacent to a first side of the center plate;

a second plate mounted to the upper frame adjacent to a second side of the center plate opposite the first side; and a locking member mounted to the first plate to selectively engage at least one of the adjustment holes such that when the locking member is disengaged from the adjustment holes, the upper frame pivots within a range of predetermined angles relative to the lower frame, and when the locking member is engaged in at least one of the adjustment holes, the upper frame is locked at a predetermined angle determined by a position of the at least one engaged adjustment hole in the center plate; and a set of angular support members spaced apart along a peripheral surface of the lengthwise members to form a v-shaped opening above the upper frame member to support a skid plate therein;

wherein the pivot assembly is connected between the pair of lengthwise members such that the pivot assembly is located substantially in the middle of the rectangular shape.

3. An apparatus to support a skid plate during installation to a vehicle, comprising:

a lower frame;

a lifting apparatus mounted to the lower frame;

an upper frame mounted to the lifting apparatus such that the lifting apparatus selectively raises or lowers the upper frame relative to the lower frame to adjust the height of the skid plate relative to an installation surface of the vehicle, the upper frame being rotatable about a longitudinal axis of the lifting apparatus and pivotable about an axis generally perpendicular to the longitudinal axis to orient the skid plate relative to the installation surface;

a pivot assembly to mount the upper frame to the lifting apparatus, the pivot assembly comprising:

a center plate having a support member rotatably connected to the lifting apparatus such that the center plate rotates about the longitudinal axis of the lifting apparatus via the support member, the center plate including a plurality of adjustment holes therein;

a first plate mounted to the upper frame adjacent to a first side of the center plate;

a second plate mounted to the upper frame adjacent to a second side of the center plate opposite the first side; and a locking member mounted to the first plate to selectively engage at least one of the adjustment holes such that when the locking member is disengaged from the adjustment holes, the upper frame pivots within a range of predetermined angles relative to the lower frame, and when the locking member is engaged in at least one of the adjustment holes, the upper frame is locked at a predetermined angle determined by a position of the at least one engaged adjustment hole in the center plate;

wherein the lifting apparatus comprises a hydraulic jack including a base portion mounted to the lower frame and a reciprocating jack piston extending from the base portion to the center plate; and an air pump assembly mounted to the lower frame to operate the hydraulic jack including a control unit to selectively raise and lower the hydraulic jack according to input of a user.

4. The apparatus of claim 3, further comprising a plurality of wheels mounted to the lower frame wherein at least two of the wheels comprise automatic drive wheels to facilitate directional movement and steering of the apparatus.

5. The apparatus of claim 3, further comprising a set of support legs respectively mounted to corner portions of the lower frame to support the lower frame above a ground surface, each of the support legs including a wheel to facilitate movement of the apparatus about the ground surface.

6. The apparatus of claim 5, wherein the support legs comprise telescoping support legs to selectively raise and lower the lower frame relative to the ground surface.

7. The apparatus of claim 5, wherein the support legs comprise pivoting hydraulic legs to selectively pivot between a substantially horizontal orientation and a substantially vertical orientation, wherein the substantially horizontal orientation corresponds to a lowered position of the lower frame relative to the ground surface, and the substantially vertical position corresponds to a raised position of the lower frame relative to the ground surface.

* * * * *